US006094953A

United States Patent [19]

Evans

[11] Patent Number: 6,094,953

[45] Date of Patent: Aug. 1, 2000

[54] ELECTRICALLY CONTROLLED SLIDEBOLT LOCK

[75] Inventor: Walter Evans, Richmond, Ky.

[73] Assignee: Mas-Hamilton Group, Inc., Lexington, Ky.

[21] Appl. No.: 09/189,775

[22] Filed: Nov. 10, 1998

[51] Int. Cl.[7] ..... E05B 49/00

[52] U.S. Cl. ..... 70/278.1; 70/303 A

[58] Field of Search ..... 70/278.1, 303 A, 70/303 R, 333 A, 333 R, 469

[56] References Cited

U.S. PATENT DOCUMENTS

| | | | |
|---|---|---|---|
| 4,904,984 | 2/1990 | Gartner et al. | 70/333 R X |
| 5,257,519 | 11/1993 | Miller, III | 70/303 A |
| 5,271,253 | 12/1993 | Cassada et al. | 70/333 R X |
| 5,307,656 | 5/1994 | Gartner et al. | 70/303 A X |
| 5,511,401 | 4/1996 | Brooks et al. | 70/303 A |
| 5,542,272 | 8/1996 | Heinemann | 70/303 A X |
| 5,588,318 | 12/1996 | Osborne | 70/469 |
| 5,592,838 | 1/1997 | Clark et al. | 70/303 A |
| 5,632,170 | 5/1997 | Evans | 70/303 A |
| 5,778,711 | 7/1998 | Gartner et al. | 70/303 A X |
| 5,816,084 | 10/1998 | Clark | 70/303 A X |
| 5,893,283 | 4/1999 | Evans et al. | 70/303 A |

*Primary Examiner*—Suzanne Dino Barrett
*Attorney, Agent, or Firm*—Rustan J. Hill; Laurence R. Letson

[57] ABSTRACT

A slidebolt lock, with slidebolt displacement forces provided by a mechanism outside the lock assembly and acting on the slidebolt, is locked by a blocking member carried by the slidebolt and normally spring biased toward a blocking and locking position. The blocking member engages the lock case and denies the bolt freedom to move in an unlocking direction. The blocking member is forced to a disengaged position by an electromechanical drive, such as a stepper motor driving a cam wheel and cam follower, or a solenoid directly or indirectly acting to force the blocking member to a position within the bolt and disengaging the blocking member from engagement with the lock casing. To simplify the solenoid in one embodiment, upon slidebolt movement toward a withdrawn, unlocked position, the blocking member forms and provides a camming structure to break any residual magnetic seal of the solenoid armature to the solenoid body.

15 Claims, 11 Drawing Sheets

ELECTRICALLY CONTROLLED SLIDEBOLT LOCK

FIELD OF THE INVENTION

This invention relates to slidebolt locks and more particularly to electronically controlled mechanisms of the lock for controlling the release and locking of the slidebolt relative to the lock cases.

BACKGROUND OF THE INVENTION

Electronic locks, such as in Miller et al, U.S. Pat. No. 5,061,923, use an electric stepper motor to connect the drive connection between the dial and deadbolt. The dial is used to provide the force and mechanical input to withdraw the deadbolt to unlock both the lock and the container upon which the lock is mounted.

U.S. Pat. No. 5,587,290 discloses an electronic lock that includes a stepper motor to move an element of a drive train from an inactive position to an active position in order that rotation of the lock dial will be effective to withdraw the deadbolt.

Solenoids also are used to move a blocking member into or out of the path of a dial driven bolts. Movement of a blocking member out of the path of the conventional dial driven bolt enables the lockbolt to be withdrawn by rotation of the lock dial.

A slidebolt lock is a lock having a slidebolt which is capable of being extended outside the lock casing by means of a spring or other biasing force and subsequently being forced into the casing against the spring or biasing force by the boltwork of a safe, vault, or other similar security container on which the lock is installed. Specifically, U.S. Pat. No. 5,588,318 issued to Shelby M. Osborne and assigned to Fire King International, Nicholasville, Ky., discloses a slidebolt lock which relies on the movement of a boltwork of an associated safe or security container to cause the bolt to be displaced to a withdrawn position within the casing of the lock. In such a slidebolt lock, the bolt may be locked in an extended position by a member which prevents movement of the bolt from a locked to an unlocked position.

The Osborne slidebolt lock is designed so that an enlarged portion of a solenoid armature shaft is insertable into and withdrawable from the slidebolt. This arrangement permits release of the bolt to allow the slidebolt to be forced to a retracted position within the lock by withdrawal of the solenoid armature shaft from the slidebolt. Once the armature is withdrawn, the slidebolt is free to move while the slidebolt is prevented from retraction if the armature is extended into the slidebolt.

The advantage of a slidebolt lock is that the slidebolt itself requires no internal mechanism within the lock casing to withdraw or to pull the slidebolt to an unlocked position. This simplifies the lock structure. The slidebolt of the lock may be either spring biased or gravity biased toward its extended position, as desired. In order to provide restoration of a spring biased slidebolt, the slidebolt pushes against a compression spring trapped between the slidebolt and the casing of the lock, thereby storing energy as the bolt is forced inwardly of the lock casing by the boltwork. Whenever the slidebolt is released, the stored energy within the compression spring then causes the slidebolt to extend outwardly, consequently locking the container upon which the lock is mounted s6 long as the slidebolt locking mechanism permitted or forced to again lock the slidebolt. In some cases, the slidebolt and lock may be positioned such that gravity acts to extend the slidebolt out of the lock casing, thus obviating the need for the spring. In most cases whenever the appropriate conditions for extension of the slidebolt are met, the spring is used to reliably insure this extension.

OBJECTS OF THE INVENTION

It is an object of the invention to improve the security of a slidebolt lock.

It is another object of the invention to use electrical power to control the displacement of a locking or blocking member such that, upon the displacement of the blocking member, the bolt is free to be forced back within the lock casing as a result of the operation of a boltwork.

It is a still further object of the invention to improve the mechanism for displacing the blocking member to improve reliability.

It is still another object of the invention to insure that a low power, low energy consumption electronic device may be used to control the movement of the blocking member to permit the slidebolt to be controlled electronically without consuming a significant amount of electricity, adapting the slidebolt lock mechanisms to the types useful in locks with self-generated power or long life battery.

SUMMARY OF THE INVENTION

The invention may take one of several forms. The constant for each is a lock frame or case, which is generally similar to cases for other combination locks, but formed to accept an angularly oriented slidebolt which may be withdrawn with forces external to the lock. A primary design difference in a slidebolt lock case is that the slide is disposed on an axis which forms an angle, either acute or obtuse depending on where the angle is measured, with the end of the lock case or lock casing. If acute, the angle of bolt orientation is approximately 45 degrees. The slidebolt will extend out of the case at an angle and typically will engage a boltwork.

The slidebolt is designed to be disposed so that the center line of the slidebolt is coincident with the center plane of the lock casing parallel to the mounting surface. This design feature permits the lock to be mounted in various positions without utilizing adapters or shims with either of the main faces of the lock case adjacent the vault door.

With the turn of a handle or wheel on the outside of a vault, the boltwork acts to extend or withdraw bolts which are found in a vault or a safe door and extend in a coordinated manner into the jam of the vault or safe. Thus, there are a plurality of locking members or bolts extending from the vault door into the jam of the vault opening so that the door is much more secure than should only a single bolt be used to hold the door in a closed and locked condition. Boltworks commonly have a single driving member or handle which rotates a plate or translates a bar. In order to cam or withdraw the various bolts extending from the door of the vault into the jam of the vault opening, the rotation of the driving member affects the boltwork on the interior of the vault door; in turn, the boltwork extends or retracts the bolts within the vault door. The function of the slidebolt in the slidebolt lock is to prevent the movement of the boltwork so that the bolts of the locking mechanism of the door of the vault cannot be withdrawn.

The movement of the boltwork member is accomplished by an external handle due to the relatively large forces required. Any time the lock is in an unlocked condition, i.e., the internal workings and/or elements of the lock have been conditioned to permit the lock to open, the rotation of the driving handle of the boltwork assembly will physically force withdrawal of or will force the slidebolt back into the casing of the lock, typically against the force of gravity or a restore spring. Thus, it is apparent that there is no mechanism internal to the lock casing of a slidebolt lock to physically withdraw the slidebolt or to pull the slidebolt into the lock casing itself. In most instances, the only thing that retains the lockbolt in its withdrawn condition is the boltwork blocking lockbolt extension.

To lock the device, a blocking pin may be disposed within an opening formed into the slidebolt, with the blocking pin extending from one side surface of the slidebolt such that the pin also partially resides in a hole in the lock casing, preventing the retracting motion of the bolt.

Some bolt works have rotary members which contact the slidebolt of the lock, while others have sliding members which contact a face of the slidebolt of the lock. The precise form of the boltwork is not material to the invention as claimed herein except that it is preferable to have a roller installed in the outboard end of the slidebolt which interfaces with the boltwork member to reduce the forces needed to operate the boltwork.

For purposes of illustration in some embodiments described below, a rotary member of the boltwork will be used. Nevertheless, it should be understood that the bolt on the slidebolt lock may be engaged with a sliding boltwork member and function with efficiency and operability either with or without such a bolt roller.

The Osborne Patent, U.S. Pat. No. 5,588,318 illustrates a simple boltwork mechanism.

Having summarized the common portions of the slidebolt lock and its interaction with the boltworks of a security container, now it will be undertaken to summarize the various embodiments of the invention.

Although similar to the other lock embodiments discussed later, the first embodiment utilizes a stepper motor with a starwheel provided. The starwheel either accepts a ball bearing into one of its depressions or low rises or forces the ballbearing away from the axis of rotation of the starwheel by engaging the ball with one of the high rises of the starwheel. In this first embodiment, the slidebolt of the slidebolt lock is formed with a hole, preferably drilled, transverse to the axis of motion of the bolt and extending substantially into the bolt. A compression spring and a cylindrical pin are deposited within this hole. In turn, the cylindrical pin is forced by the compression spring to extend out of the slidebolt to engage the ballbearing which resides, at least partially, within a channel or hole in the frame of the slidebolt lock casing.

Whenever the ballbearing is riding on the high rise of the starwheel, the ballbearing is fully displaced toward the edge surface of the slidebolt. Accordingly, the end surface of the bridging or blocking pin is substantially in the same plane as the outside surface of the slidebolt. Thus, whenever a force is exerted on one of the end surfaces of the slidebolt by the boltwork, the slidebolt may be forced into a withdrawn or retracted position within the lock casing, because the ballbearing and the pin at their contact points form a shear line or shear plane which then is aligned in the same plane as the lock case slide channel/slidebolt side interface. With such shear plane alignment, the bolt and pin may slide relative to the lock case and the ball. With the slidebolt withdrawn, the pin will be retained in its retracted, non-blocking position by the slide channel of the lock casing. Upon restoration to its locked position, the slidebolt will realign the pin with the ballbearing and may extend toward the ballbearing to bridge and block the lock casing and the slidebolt, immobilizing the slidebolt.

To relock the lock, the stepper motor is stepped, rotating a starwheel to a locking position and the ballbearing then either may remain in its guide channel or may recede partially out of its guide channel into one of the recesses or low rises of the starwheel.

Thereafter, whenever the boltwork of the vault or safe allows the slidebolt to return to its extended position, the spring force will urge the pin outward from of the slidebolt as the pin aligns with the hole containing the ballbearing and will extend partially into that channel or hole. Once the pin has extended partially into that channel or hole, the bolt may not be forced back into a retracted or unlocked position without shearing the pin, because the pin bridges the slidebolt and the lock case. Inasmuch as the pin is preferably made of material selected to be highly resistant to such high shear forces, the bolt will not be capable under most circumstances of being forced into an unlocked position.

Unless reset, the unlocking of the lock will permit the slidebolt to be extended and retracted as many times as desired during the day. At the end of the day or period of access, the lock can be relocked by firing or pulsing the stepper motor to cause it to reposition the starwheel to a "locked" position.

The bolt of the slidebolt lock may be provided with an extension leg which can be used to activate a microswitch such that the position of the bolt may be electronically determined at any time. Further, the actions of the controls can be controlled in accordance with the position of the bolt if so desired.

By using a pair of pins, with the ends thereof engaged with each other thereby forming a shear line or shear plane with the pin that is exterior to the bolt engaged by the ball as earlier explained, the relationship between the rises and the "locked/unlocked" conditions may be reversed.

In the second embodiment, the bolt of the slidebolt lock is formed with two channels cut into a side face of the slidebolt lock rather than the cavity for the spring and the blocking pin of the first embodiment. The channels are provided with sloping side walls which slope from the bottom or depth of the channel to the surface of the bolt in a manner such that, under some conditions, a protruding ball may ride up or down the slope as the slidebolt is moved inwardly or outwardly of the lock casing. The two channels are spaced apart from each other by the distance the bolt travels from a fully extended, locked position to a fully retracted, unlocked position.

A ballbearing is positioned in a constraining channel or hole formed in the casing of the lock and is disposed to protrude from the hole into one of the two channels formed into the slidebolt. The ball is sized to permit it to be withdrawn into a recess or depression in a starwheel or cam wheel whenever a recess, low rise or low dwell on the starwheel is aligned with the ball. Withdrawal of the ball permits the slidebolt to be moved along its sliding axis.

Once the slidebolt has been forced back into the slidebolt lock casing and the boltwork has been manipulated to unlock the vault, the second of the two channels aligns with the ballbearing. The ballbearing then may be selectively forced, by the rotation of the starwheel, to protrude into the second channel, thereby holding or retaining the slidebolt in its retracted and unlocked position.

A stepper motor controls the rotation of the cam wheel or starwheel to control the ballbearing movement into and out of the channels in the slidebolt. The stepper motor is controlled by electrical signals.

This second embodiment of the slidebolt lock permits the locking of the slidebolt in its retracted position as well as permits the container itself to remain unlocked for significant periods of time allowing the door of the vault to be closed and the bolts of the boltwork extended yet not locked. This condition, vault door closed, bolts extended, slidebolt not extended, and lock unlocked is referred to as "a day locked condition." Thus, the boltwork and the door of the vault may be opened repeatedly during the day without re-entering an authorized combination, permitting the vault to remain closed and appear to be closed and locked; yet authorized individuals may open, enter, re-open and re-enter the vault. This is advantageous from a safety standpoint but provides little or no security against any unauthorized entry or theft.

In order to lock the vault, after the stepper motor of the slidebolt lock has acted to fix the slidebolt in its withdrawn position, the lock must be operated again in order to permit locking. This operation will cause an electrical signal to be sent to the stepper motor causing the stepper motor to rotate and drive the starwheel to present a recess or low rise of the starwheel in alignment with the ballbearing and, in turn, to allow the ballbearing to be forced out of the channel in the slidebolt. Sequentially, to lock the vault, the slidebolt is permitted to be extended under either gravity or spring force and the starwheel again is rotated to hold the ballbearing in the thus aligned channel.

The third embodiment of the invention is one where a solenoid, on activation and deactivation, provides a linear output due to the axial movement of the armature of the solenoid. The axial movement of the armature is used by linking it to an input arm of a bellcrank to create an output usable for displacing the ballbearing, similar or identical to the ballbearing previously described with respect to an earlier embodiment, so that the ballbearing may be displaced toward the slidebolt. This displacement of the ballbearing forces the blocking pin into the slidebolt placing the shear plane formed by the contact of the ballbearing and end of the blocking pin at the exterior surface of the slidebolt. This re-location of the shear plane accomplishes the same function that was described earlier with respect to an earlier embodiment, i.e., the unblocking of the slidebolt by the blocking pin.

The bellcrank cam has a low rise and a high rise on its output arm; while on the input arm of the bellcrank, the armature of the solenoid is engaged with the bellcrank for the purpose of partially rotating the bellcrank about a pivotal or rotational axis. The bellcrank may be spring restored by one or more types of springs; and, the solenoid may be spring restored or electrically energized if the solenoid is a push/pull type. The bellcrank may be viewed as a sector of the starwheel (previously described with respect to an earlier embodiment) but where the bellcrank is mounted to pivot on a fixed axis, and the input to the bellcrank is provided off axis to cause the bellcrank to pivot, as opposed to being rotated, through a series of predetermined stepped positions. The positions of the bellcrank may be determined either by blocking pins or may be determined through the mechanism design by selecting a solenoid with an armature displacement exactly correlating to the necessary movement of the input point on the input arm of the bellcrank to dislocate the bellcrank the desired angular amount. Forcing the ball into the low rise also may act to partially restore the bellcrank to the desired orientation.

A fourth embodiment of the invention utilizes a solenoid and a latch, the latch acting to prevent the movement of the slidebolt from its extended locking position to its retracted unlocking position. The latch is unlatched at the appropriate time under control of the appropriate electrical signal to a solenoid in order to allow the slidebolt to be translated from its extended, to its withdrawn position. The solenoid has a typical armature plate attached to the armature shaft, and the solenoid axis or the axis of the armature of the solenoid is disposed substantially parallel to the axis of movement of the slidebolt between its extended and withdrawn positions.

The armature plate serves a dual function in this particular embodiment. The armature plate is magnetically attracted to the end of the coil of the solenoid whenever the coil is electrically energized, thus translating the armature along its axis of movement. The plate is further disposed so that the edge of the plate will contact the latch. The latch is a member which is pivotally mounted into or onto the slidebolt and its normal, at rest, locked position is one where the latch is rotated about its pivot point so that the distal end of the latch extends out of the path of the slidebolt and into an opening of the sidewall of the lock case in which the slidebolt reciprocates. The latch member then will engage, in an abutting fashion, an end surface of the opening, thereby preventing the slidebolt from being forced into the lock housing and consequently being unlocked. The latch member's position, being in a latched or locked position, is assured by virtue of a coil spring contained within a hole drilled into the bolt, orthogonally to the axis of movement of the bolt and a ballbearing disposed in that hole. The spring, disposed between the ballbearing and the bottom of the hole, urges the ballbearing outwardly. The ballbearing engages the latch member, forcing the latch member out to the extent possible, thereby insuring that the latch member is disposed to engage an abutting surface and to prevent both the latch member and the bolt from being forced back into the slidebolt housing.

In its locked position, the exposed face of the pivotable latch is extended toward the end surface of the opening and forms an interference with the free movement of the armature plate.

In order to unlock the bolt, the solenoid is provided with an electrical signal sufficient to actuate the solenoid to attract the armature plate to the solenoid coil.

Throughout at least part of its movement in order to release the slidebolt, the armature plate will engage and cam the latch away from the solenoid axis and into the slidebolt. The magnetically attracted movement of the solenoid armature causes the armature plate to be attracted to the solenoid coil. Thus the latch is cammed about its pivot point in a direction so that it will disengage the abutting surface and will compress the spring within the slidebolt, acting through the ballbearing disposed between the latch and the spring. Once the latch has been disposed and continues to be held in the position where it can no longer be effective to prevent the slidebolt's movement from its extended position to its withdrawn position, the bolt is free to slide under the influence of a boltwork of the vault on which the lock is mounted. The movement of the bolt by only a very slight amount will position the end of the latch member past the abutting surface; the latch member then no longer needs to be retained in its unlatched position by the armature plate and the latch will ride on the interior surface of the slideway in which the slidebolt moves.

As the slidebolt is retracted and held retracted by the boltworks, the solenoid may be retained in either its actuated or unactuated condition. However, upon the relocking of the container, the boltwork will be manipulated such that the slidebolt may extend either through the influence of gravity or of a spring. And, in the absence of the armature plate being attracted to and held by the magnetic field of the solenoid coil, the pivoted latch member again will be positioned such that the latch member may be allowed to re-engage the recess so that if there is any force exerted on the slidebolt and, thus on the latch, the latch will abut the abutment surface of the lock casing housing and thereby will prevent movement of the bolt to its withdrawn position.

A further embodiment of the invention similarly uses a solenoid to control a pivoting latch member described in the immediately preceding embodiment. The arrangement of the latch member, ballbearing, spring within the slidebolt and the abutting surfaces may be substantially identical to the previous embodiment. Rather than being dependent upon the armature plate as previously described, the control of the latch member is dependent upon the armature shaft of the solenoid itself. The solenoid is of a design wherein the armature rod or core is translated to extend from one end of the solenoid upon activation by an electrical signal.

The solenoid is disposed with the axis of the armature movement transverse to the axis of the movement of the slidebolt.

With the armature extending from the solenoid housing upon activation, the output of the armature of the solenoid can be and is used to displace the pivoted latch out of interference with its locking abutment surface and to act against the ballbearing and the compression spring forces from within the hole within the slidebolt. Whenever the solenoid is deactivated and the bolt extended, the force of the spring within the slidebolt and the latch will pivot into juxtaposition with the abutting surface of the lock casing and restore the armature to its unactivated position. Whenever this condition occurs, the latch will restore to its extended position and will be in a position to engage the abutting surface of the lock housing. Accordingly, the slidebolt will not be able to be translated from its extended, locked position to its unlocked, retracted position unless the solenoid is activated.

An additional aspect of this embodiment is to form the face of the latch engaged by the armature in a pair of segments such that one of the surfaces may act as a cam to cam the extended armature toward the solenoid body to break any residual magnetic seal between the solenoid body and the armature plate upon movement of the slidebolt to an unlocked position. The aspect of this embodiment prevents the solenoid from inadvertently permitting repeated unlocking of the lock once it has been locked and the solenoid de-energized.

A BRIEF DESCRIPTION OF THE DRAWINGS

Figure 12:
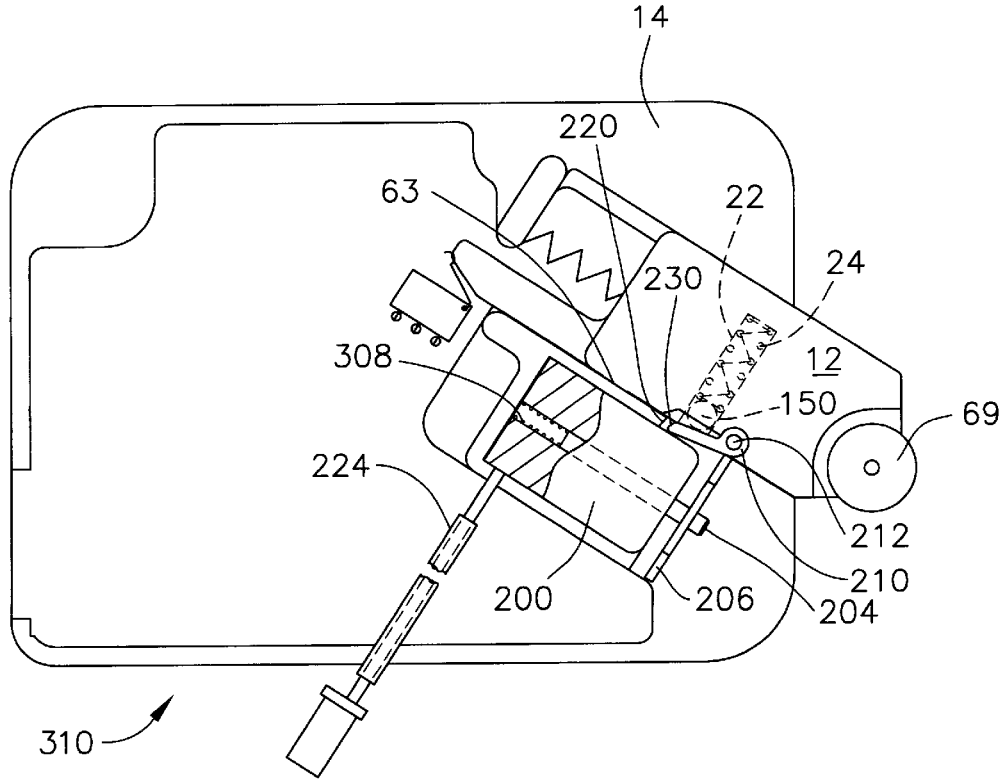

FIG. 12 illustrates a solenoid controlled latch which is biased into a latching or blocking position by a follower ballbearing and compression spring contained within the slidebolt of the lock and where the armature of the solenoid acts to move the latch from a locking position to an unlocking position upon activation of the solenoid, and action of the armature plate on the latch acts to unlatch the latch.

Figure 13:
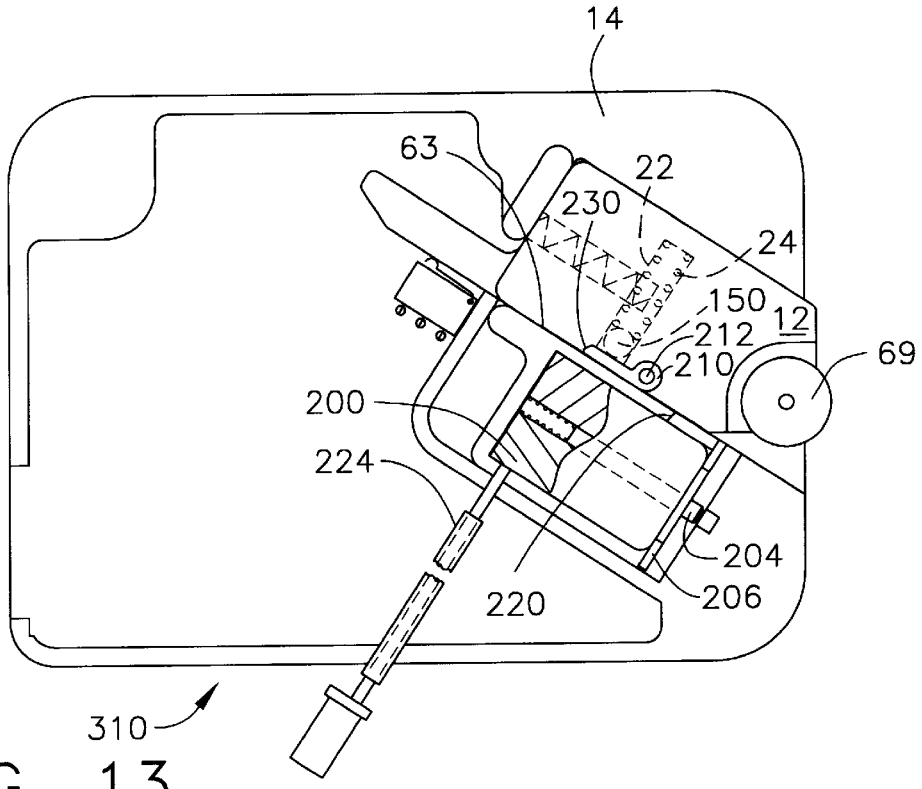

FIG. 13 is a illustration of the lock of FIG. 12 wherein the latch has been displaced to an unlocking position by the actuated solenoid armature, and the bolt has been forced to a withdrawn position within the lock housing.

Figure 14:
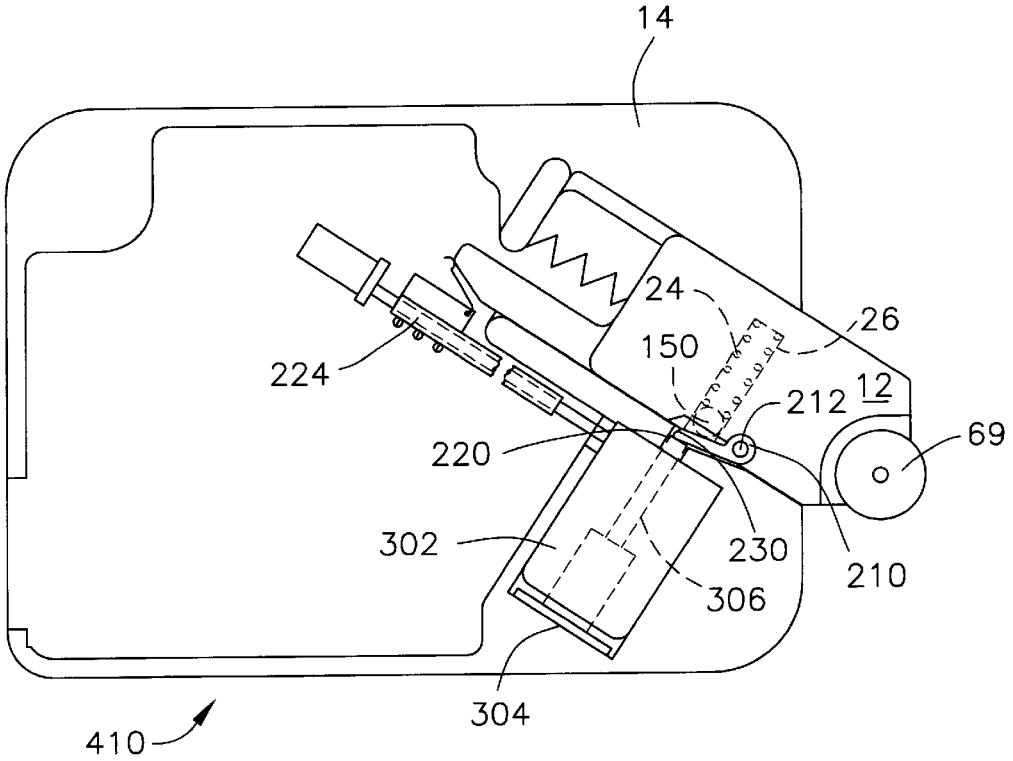

FIG. 14 illustrates a linear solenoid arranged to act directly upon a latch so that, upon activation of the solenoid, the extension of the solenoid armature causes the unlatching of the slidebolt.

Figure 15:
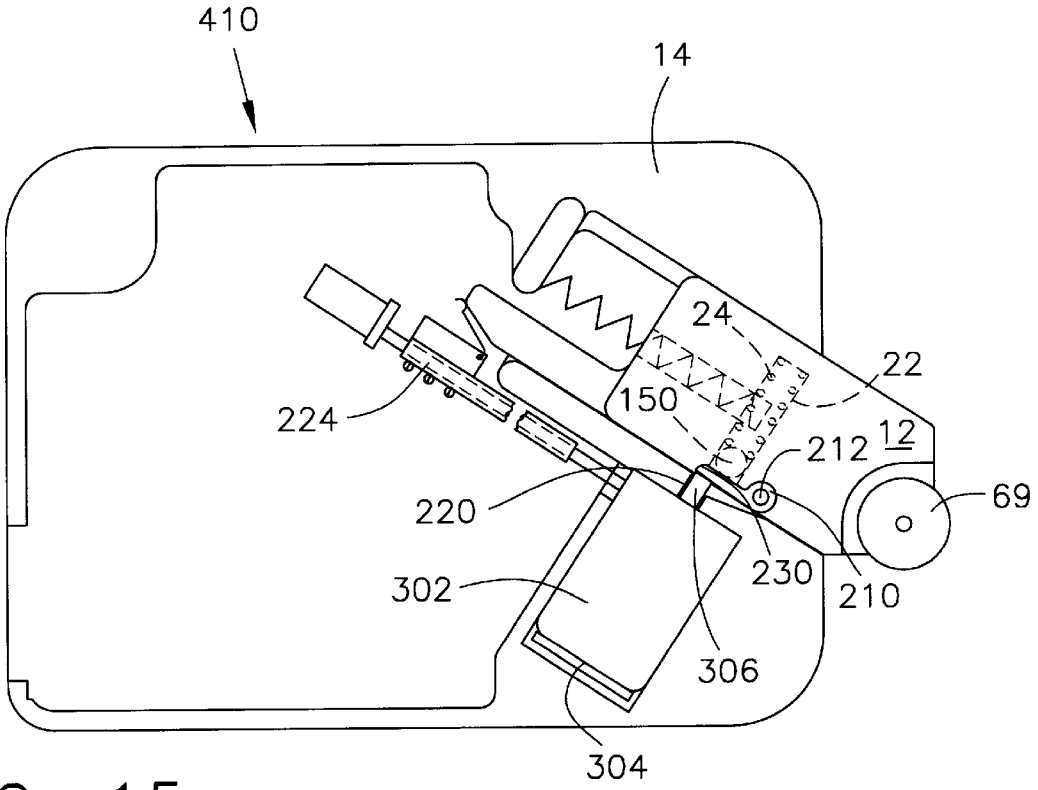

FIG. 15 illustrates the lock of FIG. 14 with the latch in a position whereby no interference exists between latch and the latching surface, thus enabling the slidebolt to be displaced into the lock casing.

Figure 16:
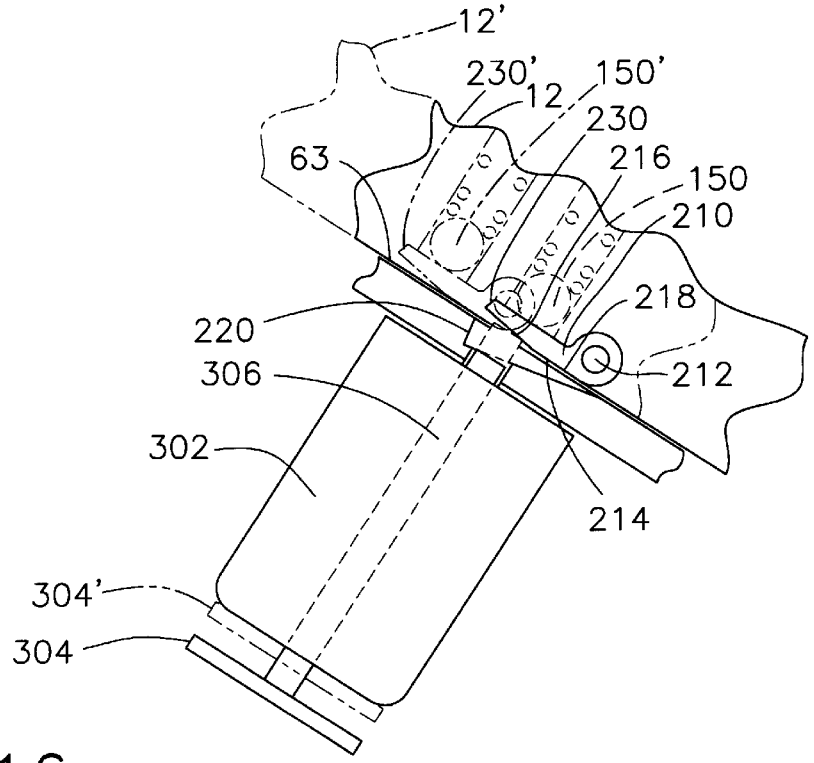

FIG. 16 illustrates an advantageous formation of the pivotable latch and its relation to the blocking surface of the lock casing and armature of the solenoid.

DETAILED DESCRIPTION

OF THE PREFERRED EMBODIMENT

OF THE BEST MODE OF THE INVENTION AS CONTEMPLATED BY THE INVENTORS

Figure 1:
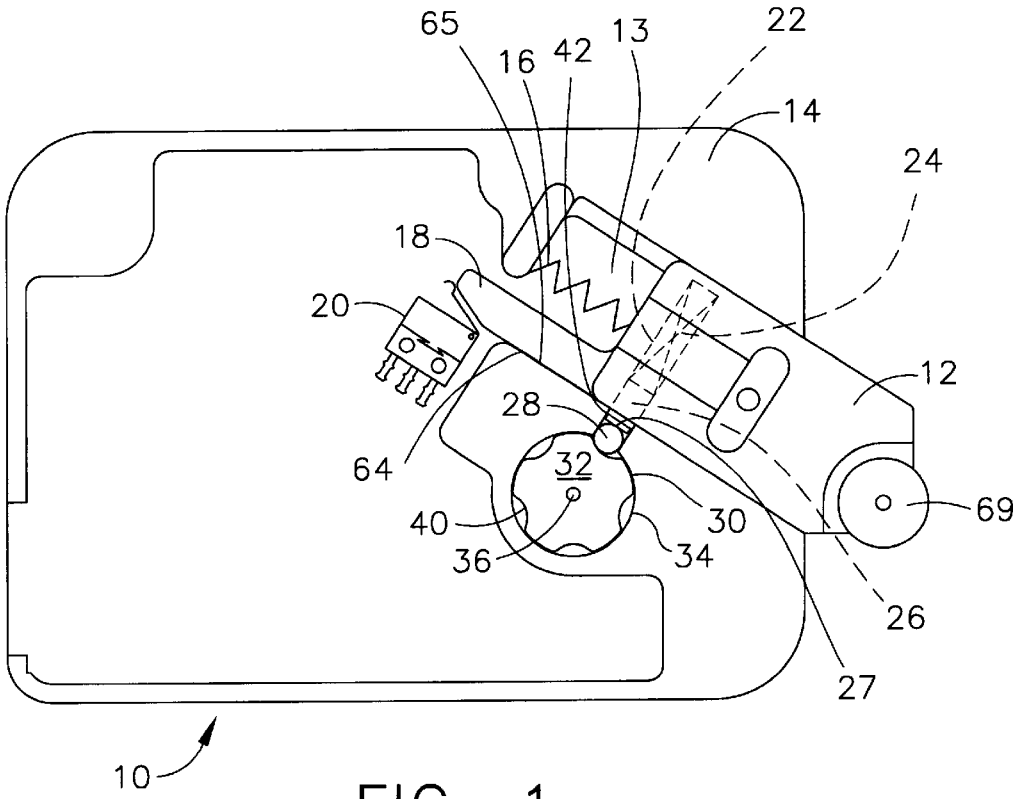
FIG. 1 is an illustration of a slidebolt lock with a stepper motor driven starwheel controlling a follower ballbearing and blocking pin which are disposed in the locked position.

Referring initially to FIG. 1, a slidebolt lock is illustrated at 10. A slidebolt lock 10 has a slidebolt 12 and a lock casing 14 within which slidebolt 12 may reciprocate between withdrawn, unlocked and extended, locked positions. Slidebolt 12 may be moved within lock casing 14 to its extended position either under the influences of gravity alone or under the influence of a restore spring 16. Slidebolt 12 also may be provided with an extension or tail 18 for stability or for other purposes such as contacting and controlling a microswitch 20. Microswitch 20 may be used to maintain or provide a monitoring signal indicating the position of slidebolt 12.

Slidebolt 12 further is provided with an internal cavity 22 which can be in the form of a blind hole drilled into the side of slidebolt 12 or a hole formed by any other conventional manufacturing process. The blind hole or cavity 22 is advantageously used to contain and constrain a compression spring, schematically illustrated at 24, together with a blocking pin 26. Blocking pin 26 is sized to slide freely within cavity 22 under the influence of compression spring 24. Engaged with the end 27 of blocking pin 26 is a follower ballbearing 28. Follower ballbearing 28 serves various functions. One significant function of follower ballbearing 28, in conjunction with blocking pin 26, is to form a shear plane or shear line at their respective common points of contact. The blocking pin 26 and follower ball or ballbearing 28 are dimensioned such that whenever follower ballbearing 28 is riding on or in contact with a high rise 30 of a cam or starwheel 32, the shear plane between ballbearing 28 and blocking pin 26 is aligned with the interface 64 of slidebolt 12 and the interior 65 of the channel 13, within which slidebolt 12 reciprocates, in lock casing or lock housing 14. This alignment permits the blocking pin 26 to translate along with slidebolt 12 whenever slidebolt 12 is moved to its withdrawn position within lock housing 14.

To control the locking and unlocking of the slidebolt 12, stepper motor 34 is connected by shaft 36 to starwheel 32 which has a plurality of high rises 30 and a plurality of low rises 40, which will receive the follower ballbearing 28 whenever properly rotationally aligned therewith. High rise 30 and low rise 40 act as cam dwells with the low rise 40 further cradling the follower ballbearing 28.

Whenever follower ballbearing 28 is aligned with low rise 40, due to the positioning of starwheel 30 by stepper motor 34, the ballbearing 28 permits blocking pin 26 to be partially forced out of its cavity 22 and into hole 42, which contains ballbearing 28, sufficiently to bridge between slidebolt 12 and lock housing 14. In the event that the follower ballbearing 28 is resident in low rise 40 at a time that slidebolt 12 is withdrawn within lock case 14, then compression spring 24 will act on blocking pin 26 to force blocking pin 26 outwardly upon the realignment of the blocking pin 26 with the hole 42. Once this realignment occurs and compression spring 24 extends blocking pin 26, blocking pin 26 will act to block movement of slidebolt 12, up to its shear strength capacity, in the position illustrated in FIG. 1.

Figure 2:
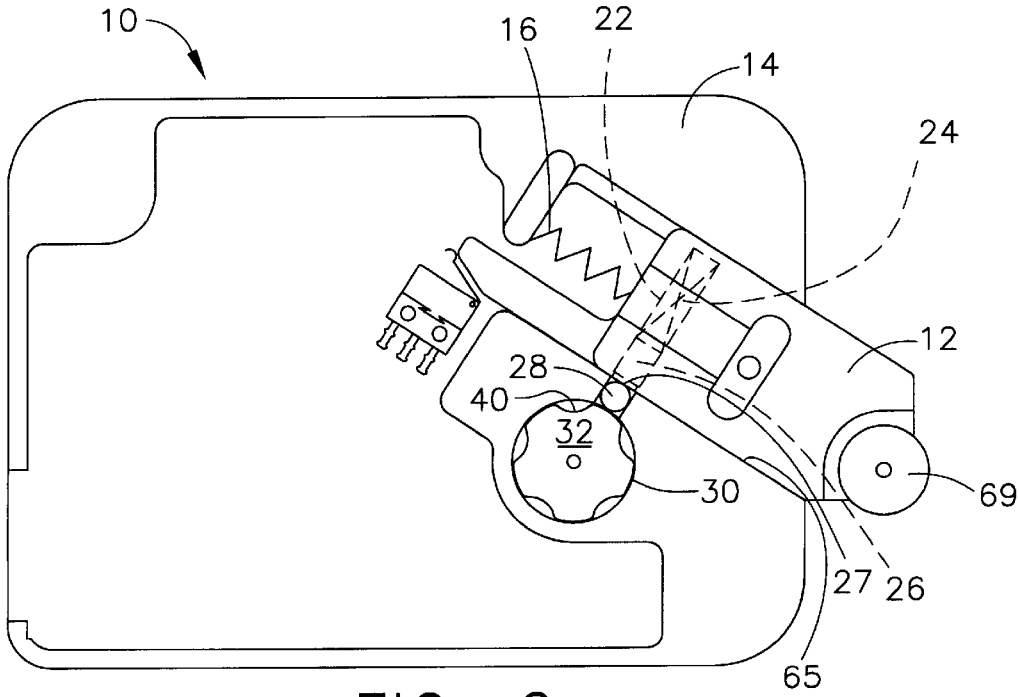
FIG. 2 is an illustration of the lock in FIG. 1 with the follower ballbearing and blocking pin in unlocked position with the bolt extended.

FIG. 2 illustrates the position of the follower ballbearing 28 in its extended or high rise position, engaging or riding on one of the high rises 30 on starwheel 32. In this condition, blocking pin 26 is totally received by internal cavity 22 of slidebolt 12, and slidebolt 12 is freely capable of being moved inwardly within lock casing 14. Thus slidebolt 12 is unlocked. Positioning of the shear plane between ballbearing 28 and blocking pin 26 at the interface between the side of slidebolt 12 closest to starwheel 32 and the lock casing 14 frees the slidebolt 12 for relative movement with respect to lock casing 14.

Figure 3:
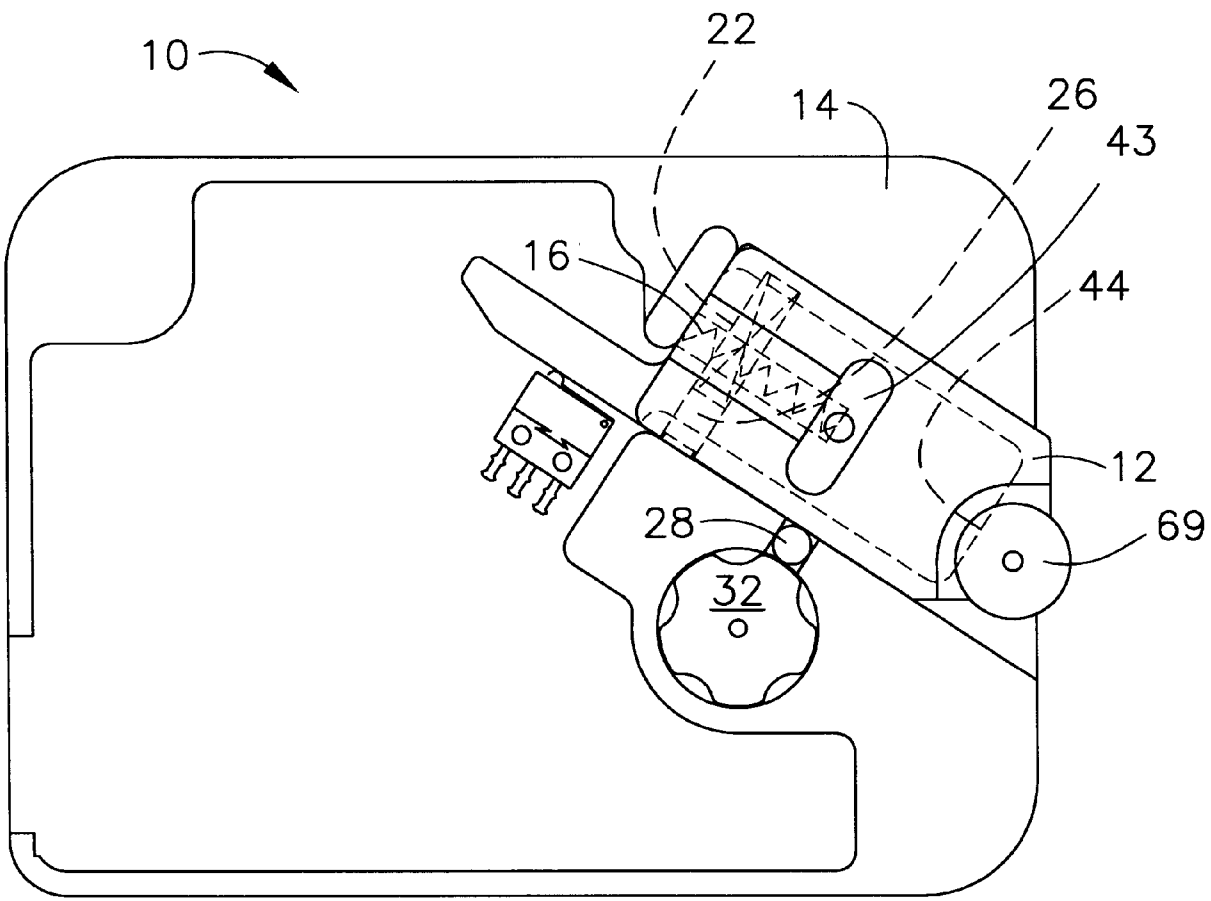
FIG. 3 is an illustration of the lock shown in FIGS. 1 and 2 with the bolt and the blocking pin displaced into the lock housing to permit unlocking of the associated security container and opening thereof.

FIG. 3 illustrates the position of the follower ballbearing 28 and starwheel 32 whenever the slidebolt 12 is retracted and almost totally received by the lock casing 14, and lock 10 is unlocked as is the container (not shown) on which the lock 10 itself is mounted. Blocking pin 26 is shown fully contained within cavity 22.

Lug 43 is formed on the side of slidebolt 12 so that lug 43 will act as a stop against surface 44 of lock casing 14, thereby preventing the slidebolt 12 from inadvertently moving out of the lock casing 14 under the influence of restore spring 16. The shape of lug 43 is not critical so long as it interferes with a lock casing surface such as surface 44, preventing slidebolt 12 from escaping while permitting freely reciprocal movement of the slidebolt 12 and not otherwise interfering with the movement of slidebolt 12.

Figure 4:
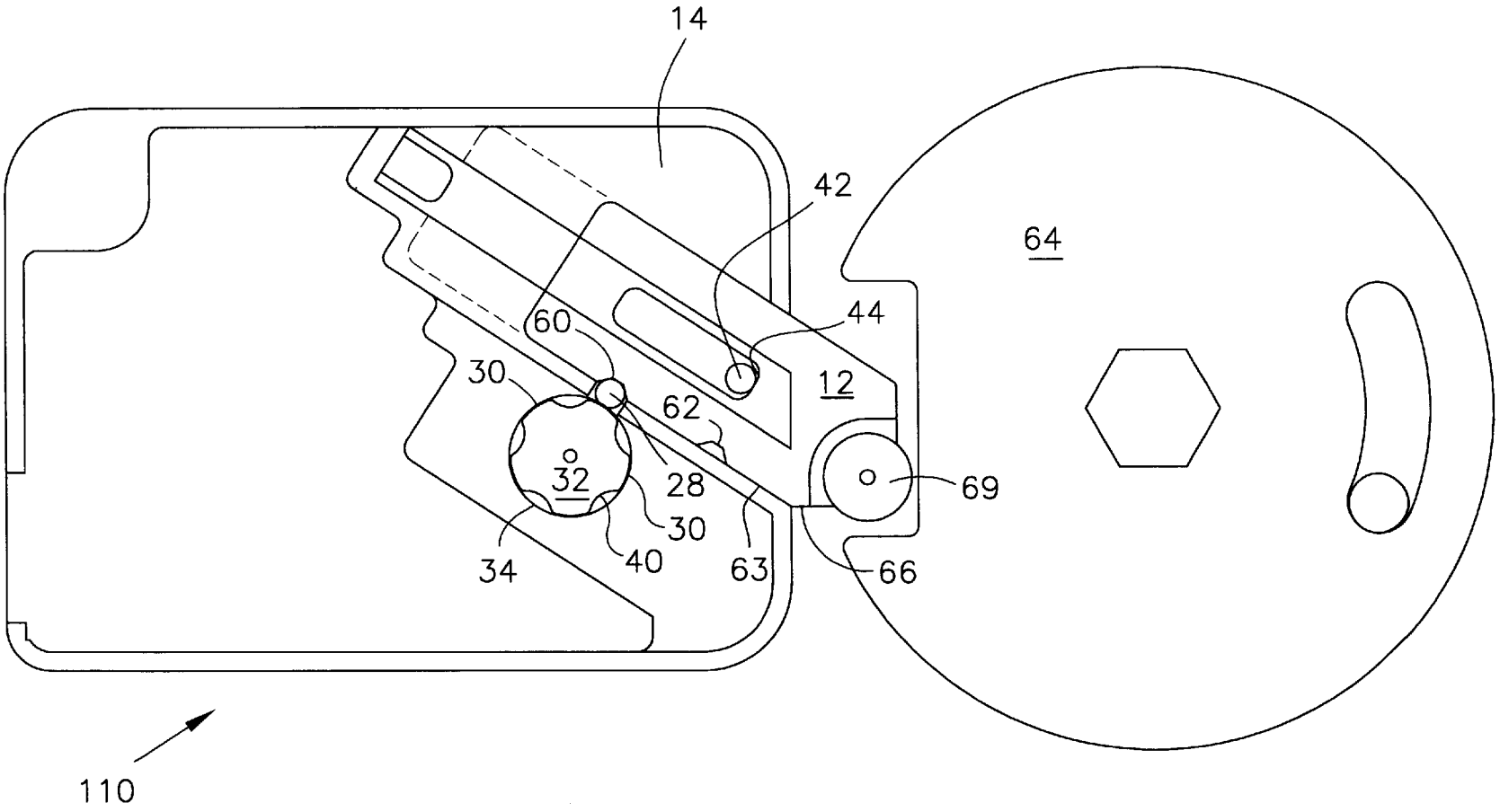
FIG. 4 illustrates an alternative embodiment of the invention wherein a stepper motor and starwheel control a follower ballbearing engageable with channels formed in the side of the slidebolt to prevent movement of the slidebolt.

In describing a second embodiment of the invention, reference is made to FIG. 4. Common elements in the various embodiments are commonly numbered with identical reference numerals; although the common elements may be illustrated in slightly different form, they perform substantially identical functions. It will not be necessary to redescribe the function and operation of each of the elements in each of the various, different embodiments inasmuch as the description once understood by one skilled in the art with respect to one embodiment will be similarly understood with respect to the other embodiments.

In FIG. 4, which is illustrative of a second embodiment, slidebolt 12 is provided with two channels 60 and 62 cut or formed into a side face 63 of slidebolt 12 closest to starwheel 32 and stepper motor 34. The channels 60, 62 are deep enough to accommodate only a portion of follower ballbearing 28 whenever follower ballbearing 28 resides on the high-rise 30 of starwheel 32. The maximum locking security resistance is accomplished with channels 60,62 receiving the follower ballbearing 28 to a depth equal to its radius. The purpose of channels 60,62 is to lock and hold the slidebolt 12 in a position, extended or withdrawn. Locking and holding can be controlled by the position of the stepper motor 34, starwheel 32, and the resulting position of follower ballbearing 28. Whenever the slidebolt 12 is fully extended and locked in its extended position, preventing the boltwork 64 from rotating and unlocking the vault (not shown), slidebolt 12 may be held in its extended position by forcing follower ballbearing 28 into channel 60 and retaining it there by rotating one of the high rises 30 of starwheel 32 into engagement with follower ballbearing 28.

Mechanical interference between slidebolt 12, follower ballbearing 28, and the starwheel 32 prevents movement of slidebolt 12 with the exception of whatever slack or tolerances may exist between the circumference of follower ballbearing 28 and channel 60. In any event, that small amount of movement of slidebolt 12 is immaterial with respect to maintaining the lock 110, slidebolt 12, and boltwork 64 in a locked and secure position.

Figure 5:
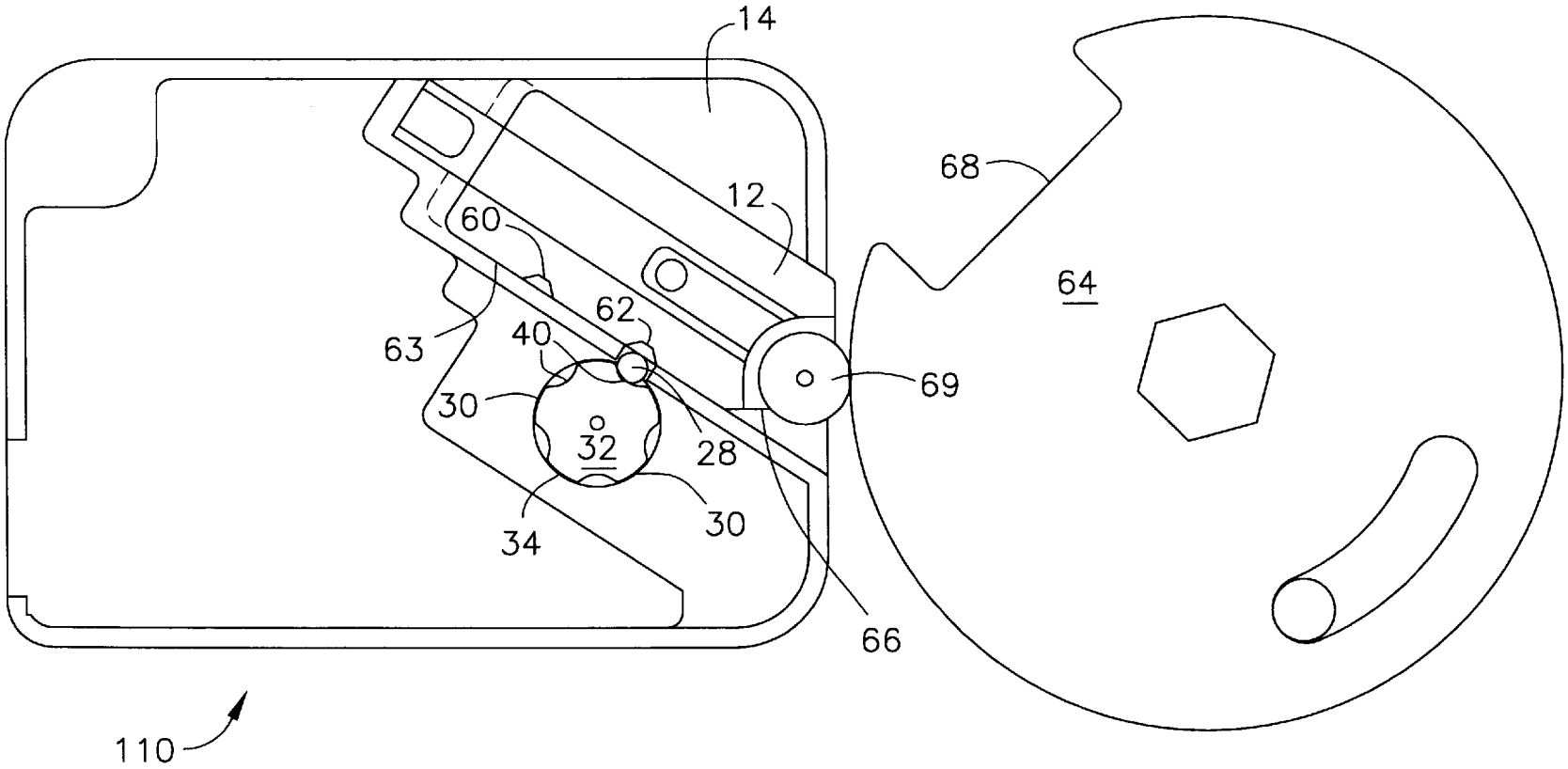
FIG. 5 illustrates the lock of FIG. 4 with the starwheel disposed to relieve the follower ballbearing from a channel in the slidebolt permitting the slidebolt to be forced into a withdrawn position within the lock housing.

Referring at this point to FIG. 5, starwheel 32 has been rotated from the position illustrated in FIG. 4 such that one of the low rises 40 is aligned with and will accept follower ballbearing 28 and allow follower ballbearing 28 to move in a direction perpendicular to the long axis of slidebolt 12 sufficiently to clear the side surface 63 of slidebolt 12. Once the side surface 63 has been cleared by follower ballbearing 28, slidebolt 12 is free to move along its axis of movement and be forced away from and out of the way of the boltwork member 64 and into the lock casing 14.

The rotation of boltwork member 64 will exert a force on slidebolt end face 66 or roller 69, mounted in the end of the slidebolt 12, in an upward direction and thereby cause a component of that force to slide the bolt 12 into the lock casing 14 to the retracted position of FIG. 5. Once the slidebolt 12 has been disposed in the retracted position, as in FIG. 5, boltwork member 64 is free to clear the slidebolt 12 and roller 69; and, boltwork member 64 may be operated to withdraw the bolts (not shown) extending from the vault door into the jam of the vault opening (not shown). The roller 69 need not be included if the force of boltwork member 64 is low enough, and the operation of the boltwork 64 and slidebolt 12 is easily accomplished.

So long as the starwheel 32 remains in the position illustrated in FIG. 5 and follower ballbearing 28 is from channel 60 or channel 62, bolt 12 is free to respond to the presentation of notch 68 of boltwork 64 to one end face surface 66 of slidebolt 12 or roller 69, if so equipped; therefore, slidebolt 12 may extend and again be retracted by the rotary movement of boltwork 64, and lock 110 will not be locked and secure.

Accordingly, lock 110 is in a completely unlocked condition and free and easy access is available to the container upon which the lock 110 is mounted without operation of the lock 110 each time the vault is to be opened.

Figure 6:
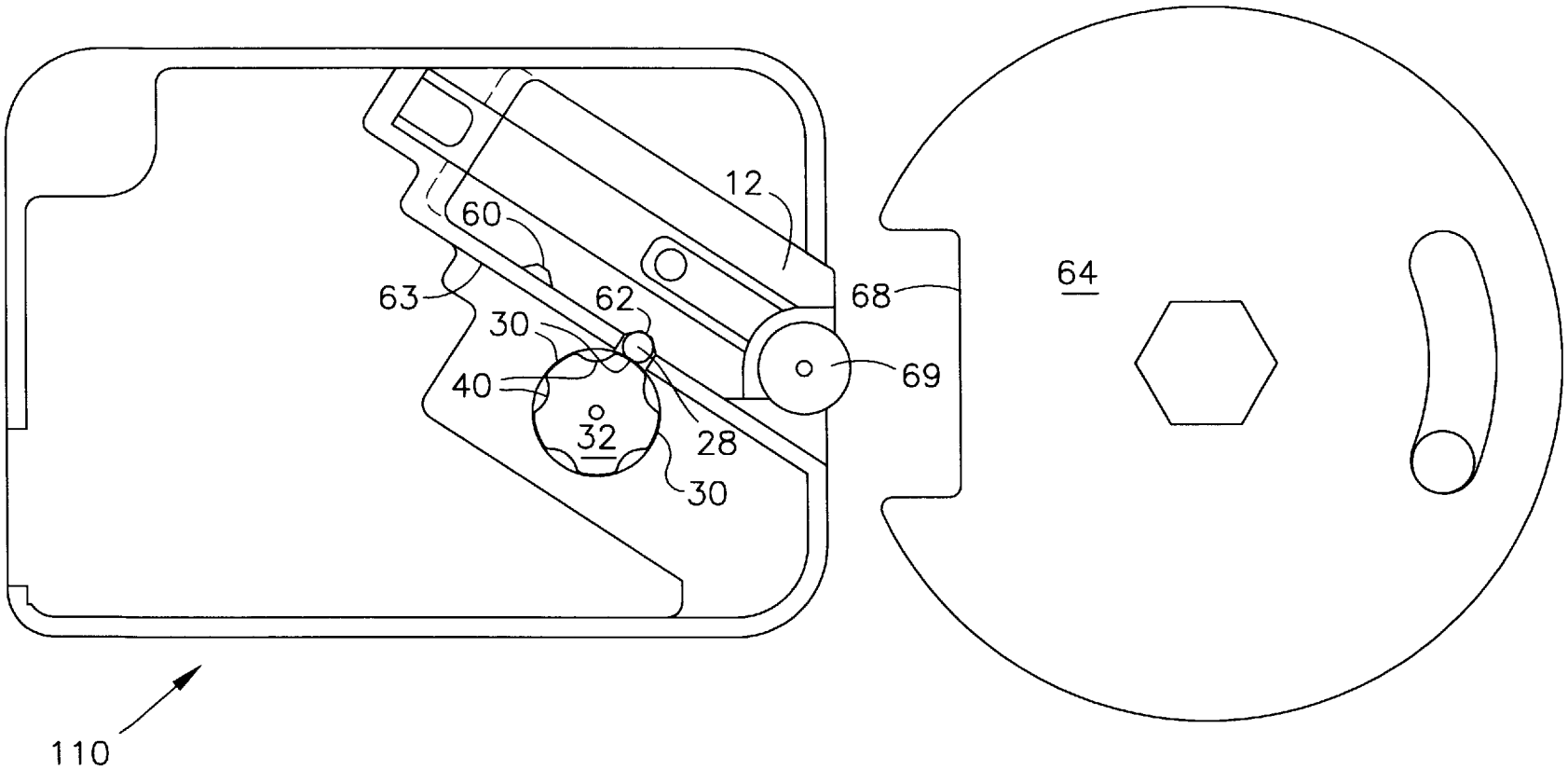
FIG. 6 illustrates the lock of FIGS. 4 and 5 with the starwheel disposed in a position to force the follower ballbearing into a second channel formed in the slidebolt, thus retaining slidebolt in a withdrawn position.

FIG. 6 illustrates the disposition of parts of lock 110, especially follower ballbearing 28 in a position projecting into channel 62, with slidebolt 12 locked in its withdrawn position by the starwheel 32 engaging the high-rise 30 with follower ballbearing 28, thus locking the slidebolt 12 in a withdrawn position. This may be implemented as a safety feature on walk-in vaults, preventing such a lock from being inadvertently locked, trapping people within the vault.

Figure 7:
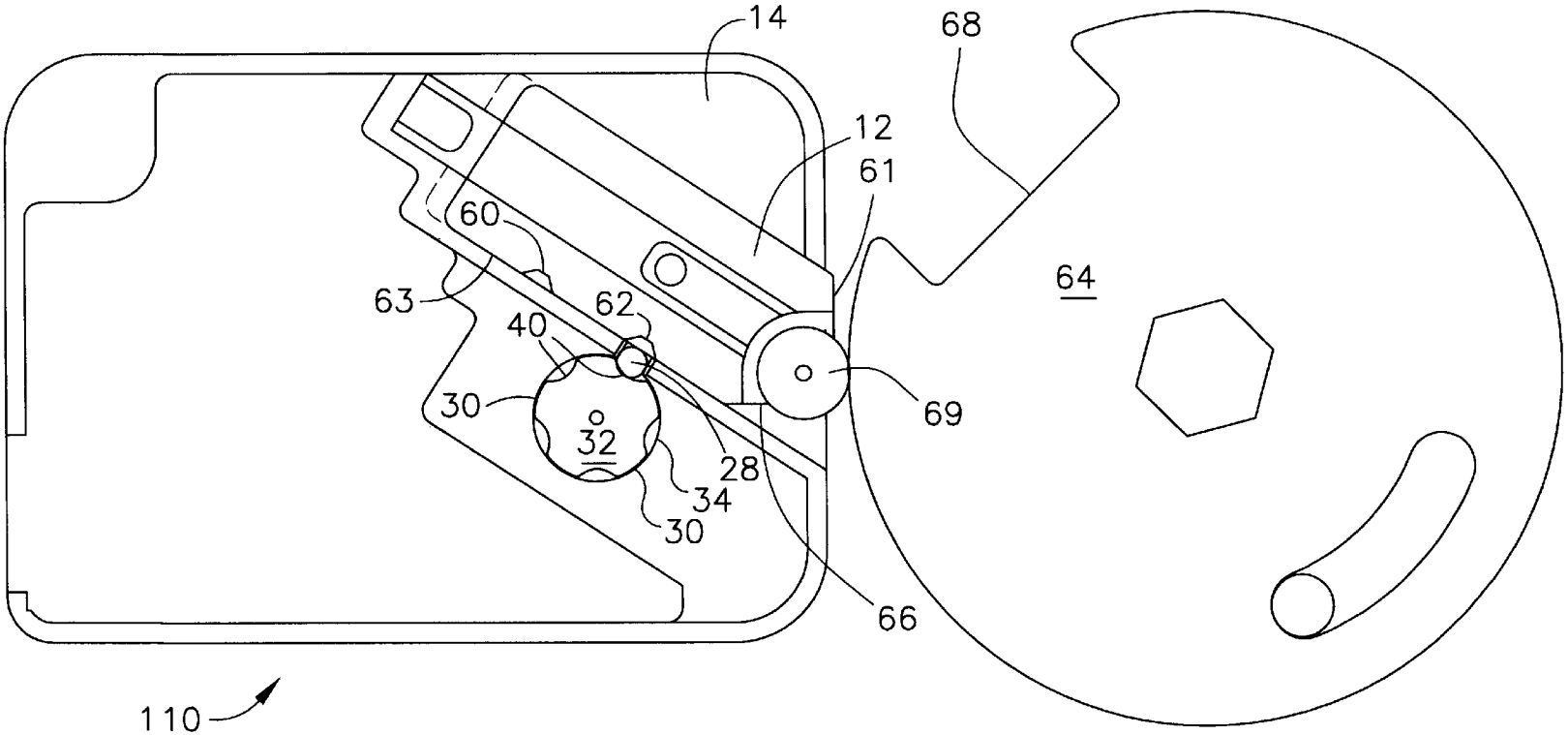
FIG. 7 illustrates the lock of FIGS. 4,5, and 6 with the starwheel disposed in a position to relieve the follower ballbearing from the second channel of the slidebolt, thus permitting the slidebolt be controlled by a boltwork of the safe or vault.

FIG. 7 illustrates the disposition of the parts of lock 10 in a condition whereby lock 110 is unlocked and slidebolt 12 is fully retracted into the lock casing 14 due to the interference with boltwork 64. As can be observed in FIG. 7, starwheel 32 is disposed by stepper motor 34 to present one of the plurality of low rises 40 to the follower ballbearing 28. In this disposition, follower ballbearing 28 is fully retracted by gravity into the low rise 40 of starwheel 32 and completely clears the side face 63 of slidebolt 12. With follower ballbearing 28 clearing the side face 63 of slidebolt 12, slidebolt 12 is free to move within lock housing 14 under the influence of boltwork 64. Thus, if boltwork member 64 is rotated in a counter-clockwise direction from the disposition illustrated in FIG. 7, notch 68 will be presented to the end 61 of slidebolt 12 and roller 69 and will allow slidebolt 12 to extend into notch 68. In extending slidebolt 12, channel 60 again will be presented in alignment with follower ballbearing 28 and will be positioned such that the stepper motor 34 may align starwheel 32 with one of the high rises 30 disposed in contact with follower ballbearing 28 thus forcing or disposing follower ballbearing 28 into channel 60.

Figure 8:
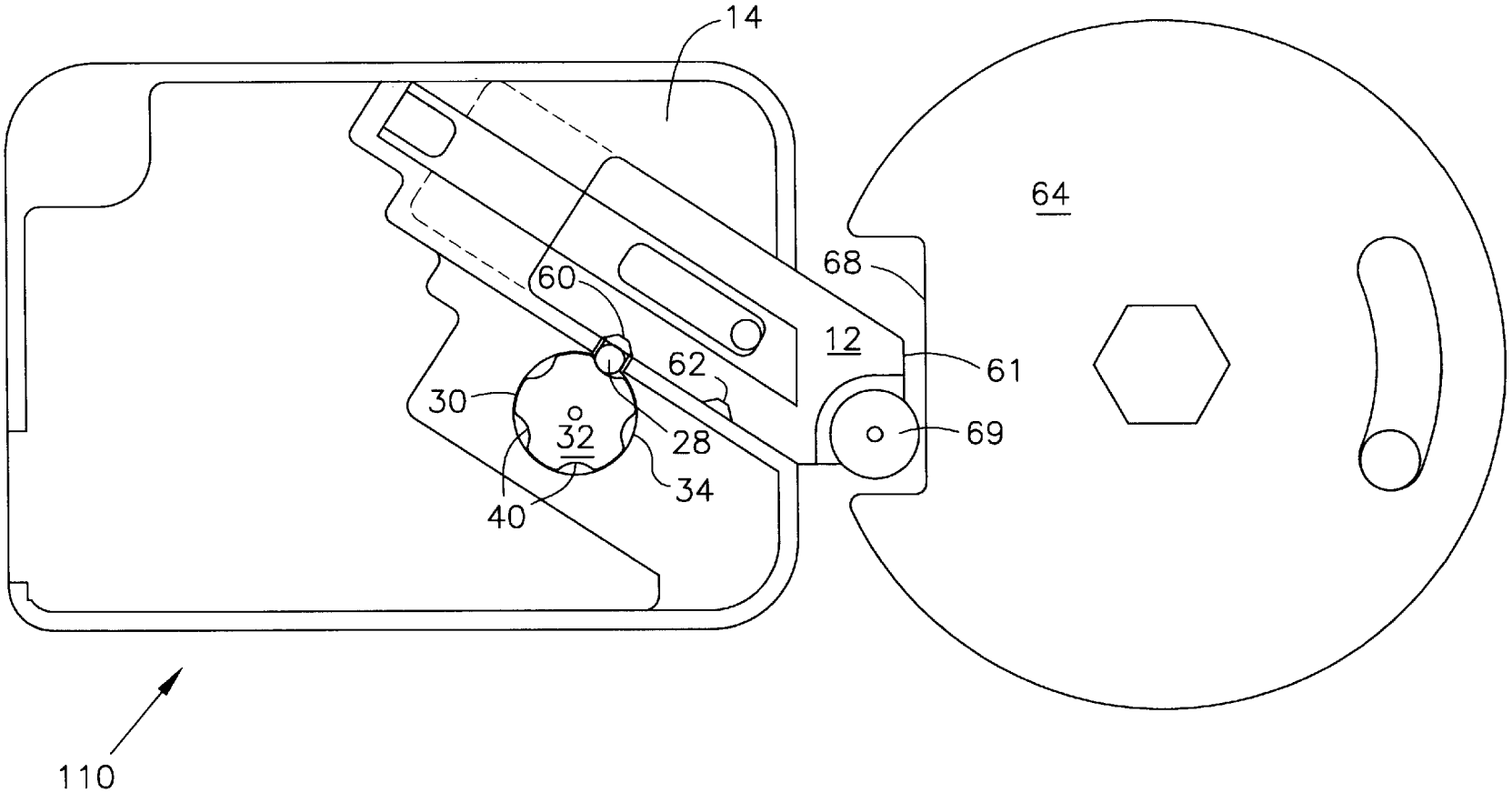
FIG. 8 illustrates the stepper motor of the lock of FIGS. 4, 5, 6 and 7 with the starwheel in a position to relieve the follower ballbearing from one of the channels of the slidebolt, thereby leaving the control of the slidebolt completely under the influence of the boltwork of the vault or safe.

In the condition illustrated in FIG. 8, lock 110 is positioned and conditioned such that, upon counter-clockwise rotation of boltworks 64, slidebolt 12 may extend into notch 68; however, a future rotation of boltwork 64, again in a clockwise direction, will cause the retraction of the slidebolt 12, because the slidebolt 12 will not be locked against movement unless stepper motor 34 rotates starwheel 32 to force follower ballbearing 28 into channel 60.

Figure 9:
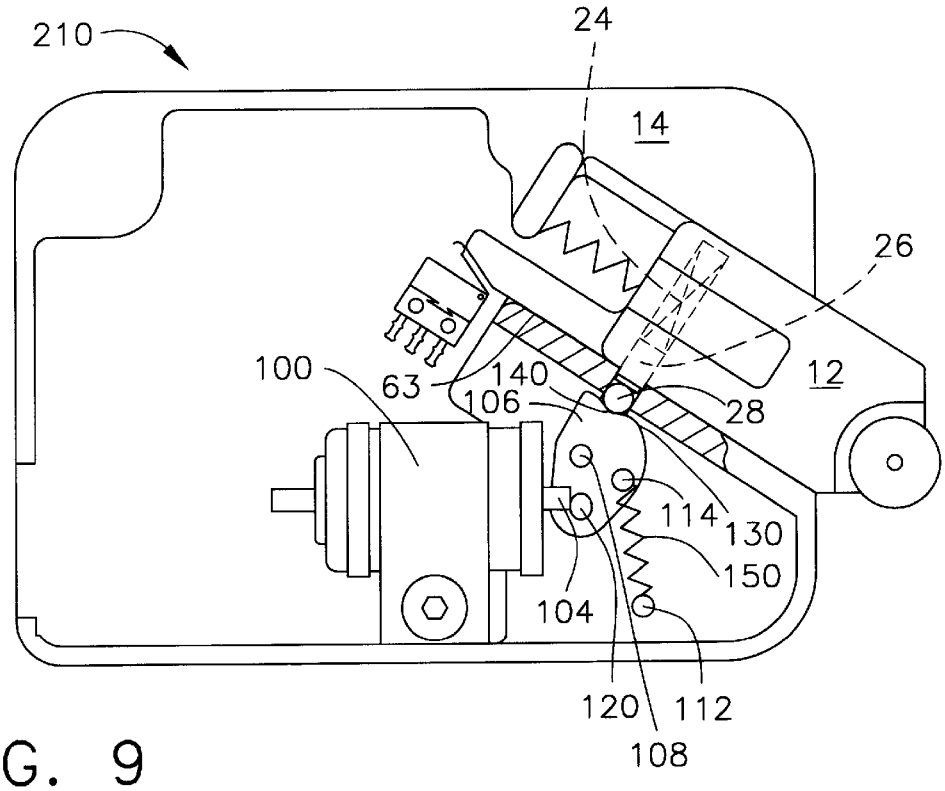
FIG. 9 illustrates another embodiment of the invention wherein a linear solenoid is connected to a bellcrank, the bellcrank having high and low rises for controlling the disposition of a follower ballbearing and associated blocking pin to control movement of the slidebolt.
Figure 10:
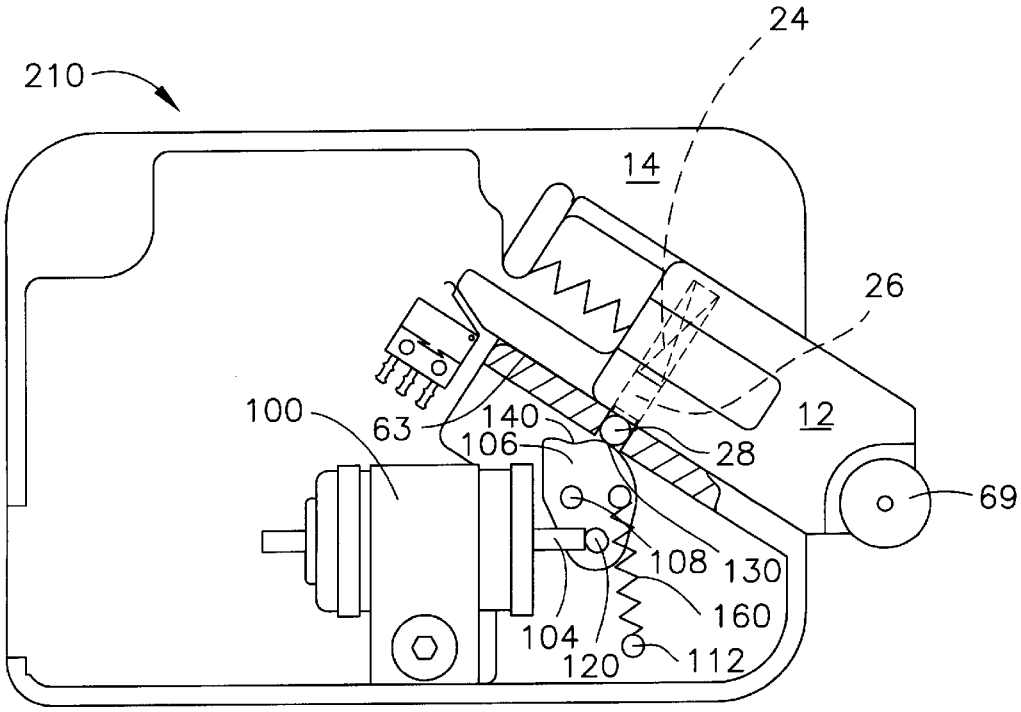
FIG. 10 illustrates the lock of FIG. 9 wherein the bellcrank is disposed to force the ballbearing and the follower blocking pin to a position where the shear plane therebetween is coincidental with the outer side surface of the slidebolt, thus permitting the slidebolt and the blocking pin to be dislocated into the lock housing.
Figure 11:
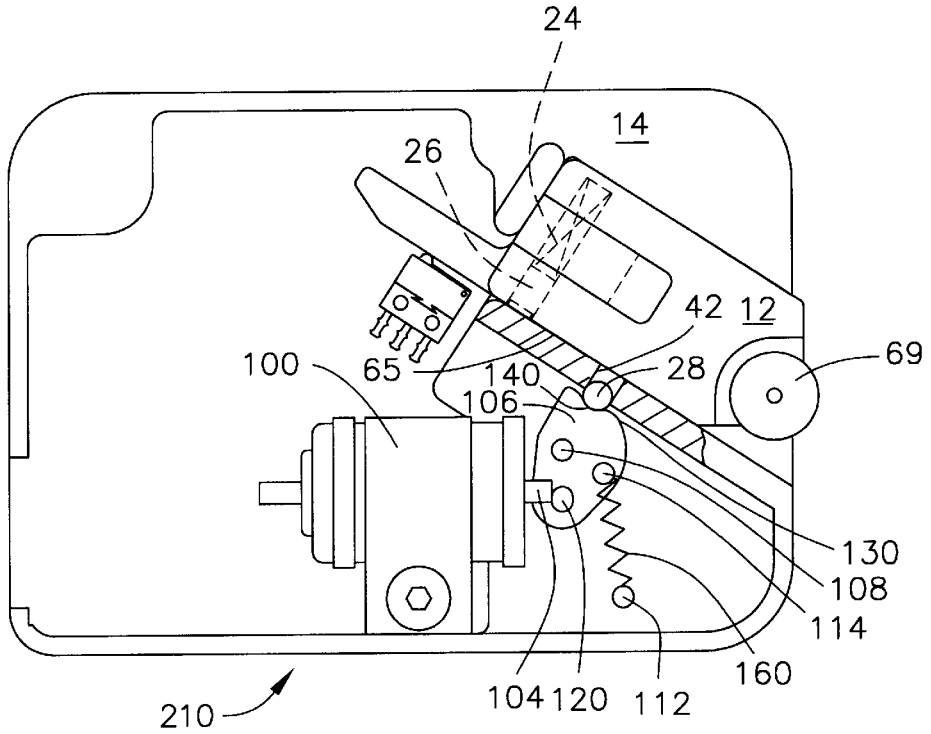
FIG. 11 illustrates the lock shown in FIGS. 9 and 10 with the bolt in a locked extended position and the bellcrank in a locked position.

A further embodiment of the invention is illustrated in FIGS. 9, 10 and 11 of the drawings. The common elements in these figures that are also found in earlier embodiments are identified by common reference numerals and not re-explained in detail. Lock 210 of FIG. 9 has a slidebolt 12 substantially identical to the slidebolts 12 of the preceding eight figures. With the exception of the mounting of a solenoid 100, lock case 14 is substantially identical in at least all relevant functional aspects to the earlier described lock cases 14.

Armature plate 101 is attracted to the solenoid 100 upon an electrical signal being impressed on solenoid 100. This reaction of the armature plate 101 extends armature shaft 104 to push a displace able device, bellcrank 106. The magnetic field seals the armature plate 101 to solenoid 100.

The electrical drive and lock control element, solenoid 100, is a "push-when-energized" solenoid, based on the output and the solenoid 100 pushing the device displaced. In the extension movement of the armature 104, the armature 104 acts on a bellcrank 106 to pivot bellcrank 106. Bellcrank 106 may be visualized, for purposes of this invention embodiment, as an arcuate segment of the starwheel 32 illustrated in preceding Figures with an input segment on an opposite side of a pivot 108. Bellcrank 106 has a high rise 130 and a low rise 140, analogous to the high rise 30 and low rise 40 of earlier Figures. The rises 130 and 140 interface with follower ballbearing 28 to control the locked/unlocked condition of slidebolt 12 in a manner substantially identical to the rises 30 and 40 of previous lock embodiments illustrated in FIGS. 1–8.

As viewed in FIG. 10, solenoid 100 has been energized and armature 104 extended rightwardly. As a result of the extension of armature 104 under the influence of the electrical activation of solenoid 100, bellcrank 106 is pivoted in a counter-clockwise direction about pivot 108 moving follower ballbearing's 28 engagement from low rise 140 to high rise 130 of bellcrank 106. Constrained against lateral movement responsive to pivoting motion of bellcrank 106, follower ballbearing 28 is incapable of movement in any direction except a radial direction with respect to the bellcrank 106. High-rise 130 of bellcrank 106 is moved under follower ballbearing 28, forcing follower ballbearing 28 outwardly from the pivot point 108 of bellcrank 106, compressing spring 24, and displacing blocking pin 26 within cavity 22 in slidebolt 12 to the point whereby the blocking pin 26 is totally resident within the boundaries and confines of slidebolt 12. Inasmuch as blocking pin 26 is contained totally within slidebolt 12, slidebolt 12 then is free to be moved into the housing 14 by forcible engagement between slidebolt 12 or roller 69 and boltwork (not shown) in FIG. 10.

Once slidebolt 12 has been displaced by the boltwork (not shown) into the lock casing 14, the solenoid 100 may be de-energized as shown in FIG. 11. Once electrically de-energized, solenoid 100 may be restored either by an internal spring within the solenoid 100, if so constructed, otherwise it may be held momentarily in its activated, sealed position by residual magnetism in the body of solenoid 100 and restored by spring 160. In either event, the ultimate restoration force for the bellcrank 106 and thus armature shaft 104 is spring 160 which causes the bellcrank 106 to pivot in a clockwise movement once the electronic signal to solenoid 100 is terminated which releases the solenoid armature 104 by allowing the collapse of the magnetic field in the solenoid 100.

With bellcrank 106 in its restored position, i.e., clockwise position, as influenced by spring 160, and with low rise 140 of bellcrank 106 positioned to be engaged by follower ballbearing 28, blocking pin 26 again will extend into the hole 42 and thereby bridge the interface between the lock casing 14 and slidebolt 12, locking slidebolt 12 against movement from an extended position to a retracted position, as shown in FIG. 9.

In FIGS. 9 and 11, bellcrank 106 is disposed in a position with the follower ballbearing 28 in the low rise 140 of bellcrank 106 and the armature shaft 104 of solenoid 100 retracted and unactuated by virtue of the pull of tension spring 110 mounted between a mounting bolt 112 and an attachment point 114 on the bellcrank 106. Bellcrank 106 is connected in a conventional manner to armature shaft 104 of solenoid 100 at connection 120.

Connection 120 may be any one of numerous types of conventional connections wherein the motion extending the armature shaft 104 is transmitted to one arm of the bellcrank 106, causing the bellcrank 106 to pivot counter-clockwise in response to electrical activation of solenoid 100.

As with the embodiment described with respect to FIGS. 1, 2 and 3, spring 24 contained within the cavity 22 in slidebolt 12 biases blocking pin 26 which, in turn, interfaces with follower ballbearing 28. The interface between follower ballbearing 28 and blocking pin 26 forms a shear plane which, when aligned with the outer surface 63 of slidebolt 12, permits slidebolt 12 to be forced back into the lock housing 14.

In the embodiment as shown in FIG. 11, the follower ballbearing 28 is engaged with low 20 rise 140 and, upon restoration of the slidebolt 12 to the extended position as in FIG. 9, allows the blocking pin 26 to span or bridge between slidebolt 12 and the hole 42 of lock casing 14 to actually lock the lock 210.

For a detailed understanding of a still further embodiment of the invention, reference is now made to FIGS. 12 and 13 with slidebolt lock 310 incorporating the invention. Slidebolt 12 has incorporated therein a cavity 22, substantially identical to the cavities 22 of embodiments described here earlier, and which similarly contains compression spring 24. Compression spring 24 engages a follower ballbearing 150. Follower ballbearing 150 may be replaced with a follower pin with a hemispherical tip (not shown), if desired. The drive for unlocking slidebolt lock 310, as illustrated in FIGS. 12 and 13, is solenoid 200. Solenoid 200 is provided with a solenoid armature shaft 204, carrying thereon a solenoid armature plate 206. The magnetic field created upon energization of solenoid 200 attracts the armature plate 206 to solenoid 100.

The solenoid 200 is disposed so that the solenoid armature shaft 204 is moveable parallel to the axis of movement of slidebolt 12. Keeper 210 or latch 210 is pivotally mounted on slidebolt 12. Latch 210 is mounted by a pivot pin 212 to pivot through a limited arc of movement. The latch 210 and pin 212 are disposed such that follower ballbearing 150 is engaged with latch 210, forcing latch 210 outward from within the boundaries or side face 63 of slidebolt 12.

Lock case 14 of slidebolt lock 310 is formed with or provided with a stop surface 220 against which latch 210 may engage whenever latch 210 is pivoted about pin 212 to its maximum extent in a counter-clockwise direction under the influence of spring 24 and follower ballbearing 150, and slidebolt 12 is extended to its locked position. As illustrated in FIG. 13, any attempted movement to withdraw or force slidebolt 12 inwardly of lock casing 14 by operation of a boltwork (not shown) will result in jamming latch 210 into stop surface 220, preventing slidebolt movement. Such interference between latch 210 and stop surface 220 will act effectively through pin 212 to prevent any further movement of slidebolt 12 from its extended, locking position to its retracted, unlocking position.

In order to permit retraction of slidebolt 12, illustrated in FIG. 12, solenoid 200 must be actuated. Connector harness 224 is an assembly providing a path for electrical energy from a conventional electrical control (not shown) to solenoid 200. The magnetic field of the energized solenoid 100 attracts solenoid plate 206 and, consequently, withdraws or retracts solenoid armature shaft 204 into solenoid 200.

Upon attraction of plate 206 toward solenoid 200, solenoid plate 206 will engage with and cam latch 210 in a clockwise direction around pin 212 against the force exerted by follower ballbearing 150 and spring 24. The rotational or pivoting motion of latch 210 will displace distal end 230 of latch 210 away from stop surface 220 and subsequently permit relative movement of latch 210, pin 212, and slidebolt 12 upward and to the left allowing withdrawal of slidebolt 12 into lock casing 14. Solenoid 200 is spring restored by internal solenoid spring 308 upon electrical de-energization.

FIGS. 14 and 15, respectively, illustrate slidebolt 12 and lock 410 in two different conditions of operation. Slidebolt lock 410 has slidebolt 12 extended from lock casing 14 in both Figures. The unlocking operation of lock 410 illustrated in FIGS. 14 and 15 is accomplished by a solenoid 302, which is oriented with the axis of movement of the solenoid armature shaft 306, and solenoid armature plate 304 being in a direction transverse to the direction of movement of slidebolt 12 from its extended, locked position to a withdrawn unlocked position (not illustrated). Armature shaft 306 is engaged with latch member 210 which, in turn, is pivotally attached to slidebolt 12 by pin 212. Latch member 210 is spring biased outwardly toward a latching blocking position by a spring 24 disposed within a cavity 22 within slidebolt 12. Spring 24 is compressed and acts against follower ballbearing 150. Follower ballbearing 150, in turn, acts against latch 210 to urge latch 210 to pivot about pivot pin 212 in a counter-clockwise direction as illustrated in FIGS. 14 and 15, substantially identical to that arrangement described with reference to FIGS. 12 and 13.

In FIG. 14, latch 210 is illustrated in its locked position, that being the position at its most complete counter-clockwise extent of travel about pin 212. Latch 210 has a distal end 230 which is shown either abutted or in close proximity to engagement surface 220. Thus, any force exerted on slidebolt 12 to cause the movement of slidebolt 12 into lock casing 14 will result in the forcible engagement of latch end surface 230 against latching stop surface 220 of lock casing 14 (substantially identical to the arrangement of these parts in FIG. 12).

Armature shaft 306 and armature plate 304 are shown in the unenergized position 304 of solenoid 302 with solenoid plate 304 displaced away from the main body of solenoid 302 in FIG. 14. Upon energization of solenoid 302 by signals carried thereto over electrical connector harness 224, solenoid 302 will create a strong, attractive magnetic field, thus pulling armature plate 304 toward solenoid body 302 to position 304', extending armature shaft 306 against the force of spring 24 in slidebolt 12. The displacement and subsequent positioning of armature plate 304 in its attracted position 304' is clearly illustrated in FIG. 15. The pivoting of latch 210 under the influence of extension of solenoid shaft 306 is illustrated also in FIG. 14. With latch 210 pivoted in its clockwise direction under the influence of the displacement of armature shaft 306, latch 210 is displace sufficiently that the end surface 230 of latch 210 will be completely disengaged from the latching surface 220 in lock casing 14. Thereafter, with the latch surface 230 disengaged from latching surface 220, slidebolt 12 is free to be displaced by an external force, such as a boltwork (not shown) retracting lock 410 and its associated security container, as illustrated in FIG. 15. Upon the discontinuance of an electrical signal to solenoid 302 and slidebolt 12 being restored to its extended position, the spring force of compression spring 24 against follower ballbearing 150 will cause pivoting movement of the latch 210 around pivot pin 212, thus repositioning latch 210 into a relationship such that the end surface 230 of latch 210 will be aligned with and engageable with the latching or stop surface 220 of lock casing 14, as shown in FIG. 15. Accordingly, the solenoid 302 need not be electrically powered whenever the slidebolt 12 is extended in order for the lock 410 to be locked and secure.

However, in the interest of higher security, a restoration scheme is shown in FIG. 16. Solenoid 302 may be held inadvertently in an actuated position by residual magnetism in the solenoid 302 if there is no solenoid restore spring such as illustrated in FIG. 12. The holding of the armature 306 by residual magnetism is commonly referred to as residual magnetic seal. To insure that any residual magnetic seal between solenoid 302 and armature plate 304 is broken upon unlocking the vault, whenever extended to pivot latch 210 to its unlatched position, armature shaft 306 engages latch surface 214.

Latch surface 214 is a compound surface having segments 216, 218. Segment 218 is positionable substantially co-extensively with slidebolt surface 63 and segment 216 is sloped and recessed within slidebolt 12 forming a camming surface relative to armature shaft 306, configured to cam solenoid armature shaft 306 away from the slidebolt 12 and separate armature plate 304 from the solenoid 302. This cam induced movement of armature plate 304 breaks any residual magnetic seal.

As slidebolt 12 is displaced leftward in FIG. 16 in an opening and unlocking movement and with solenoid armature shaft 306 fully extended against latch surface segment 216, armature plate 304 is sealed generally in position 304'. The camming action of latch surface segment 216 against armature shaft 306 will force armature shaft 306 back through solenoid 302 and displace armature plate 304 from position 304' toward position 304, breaking any residual magnetic seal.

FIG. 16 also illustrates the positions of slidebolt 12', ballbearing 150', and the tip 230' of latch 210 in displace positions representing the positions occupied whenever slidebolt 12 is dislocated to at least a partially withdrawn position 12'.

This ensures that residual magnetic fields in solenoid 302 will not interfere inadvertently with relocking of the slidebolt 12 upon restoration of slidebolt 12 to its extended position.

One of skill in the art will understand that various embodiments of the same invention have been disclosed in this specification and that as such the varying embodiments all constitute disclosure of an invention. One will further understand that the scope of the invention is defined by the claims attached hereto and not by the varying embodiments disclosed herein. Further, it should be understood that one of ordinary skill in the art may make minor changes or modifications in any of the various embodiments without making changes sufficient to remove the resulting device from the scope of the invention as defined by the claims attached hereto.

What is claimed is:

1. A slidebolt lock comprising:

a lock casing;

a bolt, said bolt reciprocally moveable within said lock casing between a retracted position and an extended position along an axis of movement;

said bolt comprising a cavity having an axis extending transverse to said axis of movement;

a blocking member disposed at least partially within said cavity for blocking movement of said bolt, said blocking member displaceable to a second position within said bolt to permit movement of said bolt relative to said lock casing, and an electromechanical drive disposed to displace said blocking member relative to said bolt to said second position for unlocking said bolt.

2. The slidebolt lock of claim 1 wherein said blocking member comprises a spring biased pin, said spring biased pin extending from said bolt into an opening in said lock case, bridging said bolt and said lock case, preventing movement of said bolt relative to said lock case, thereby locking said lock.

3. The slidebolt lock of claim 2 wherein said electromechanical drive comprises:

a stepper motor;

a cam driven by said stepper motor, and a cam follower engaged by said cam and by said blocking member for displacing said blocking member to within said bolt.

4. The slidebolt lock of claim 3 wherein said cam follower comprises a mechanical member displacingly engaged with said blocking member and said cam and displaceable in a transverse direction relative to said bolt axis of movement.

5. The slidebolt lock of claim 4 wherein said cam follower comprises a ball engaging said blocking member and said cam, said engagement of said ball and said blocking member forming a shear plane displaceable by said cam to align with an interface between said bolt and said lock case, thereby permitting movement of said bolt relative to said lock case, toward said retracted position.

6. The slidebolt lock of claim 5 further comprising a spring biasing said bolt outwardly of said lock casing, said bolt moveable against said spring bias by a boltwork.

7. A Slidebolt lock comprising:

a slidebolt;

a lock case containing and slightably confining said slidebolt for movement between an extended position and a withdrawn position;

said slidebolt comprising a cavity disposed transverse to an axis of said movement of said slidebolt, said cavity confining and containing a compression spring;

said slidebolt further comprising a latch carried by said slidebolt and pivotally engagable with said lock case for preventing movement of said slidebolt from said extended position to said withdrawn position;

said spring biasingly engaged with said latch to pivot said latch to engage with said lock case; and a solenoid actuatable for disengaging said latch from said casing.

8. The lock of claim 7 wherein said latch is a pivotable member engageable by a moveable element of said solenoid for moving said latch from a latching to an unlatching position.

9. The lock of claim 7 wherein said latch is cammed out of latching position by movement of said solenoid member to an actuated position of said solenoid.

10. The lock of claim 9 wherein said solenoid member comprises a member disposed on and moveable with an armature shaft.

11. The lock of claim 9 wherein said solenoid member comprises an armature plate.

12. The lock of claim 8 wherein said moveable element comprises an armature.

13. The lock of claim 12 wherein said moveable element further comprises a shaft extendable from said solenoid, pushingly engageable with said latch member.

14. The lock of claim 13 wherein said latch further comprises a surface engageable by said armature, said surface disposable by said armature, forming an angle with said axis, said surface further so disposed to cammingly engage said extended shaft of said armature shaft for forcing said armature shaft in a direction opposite a direction of projecting movement of said armature shaft, whereby said surface cams said armature toward a withdrawn position upon said slidebolt movement toward a withdrawn position.

15. The lock of claim 13 wherein said armature shaft is cammed by movement of said bolt toward a position where said armature is not magnetically retained in an actuated position.

* * * * *

Disclaimer

6,094,953 — Walter Evans, Richmond, KY. ELECTRICALLLY CONTROLLED SLIDEBOLT LOCK. Patent dated Aug. 1, 2000. Disclaimer filed Apr. 07, 2006 by the Assignee, Kaba Mas Corp. formerly Mas-Hamilton Group.

Enter this disclaimer to claims 1 — 15, of said patent.

(*Official Gazette May 23, 2006*)